US011146016B2

(12) United States Patent
Iwashita et al.

(10) Patent No.: US 11,146,016 B2
(45) Date of Patent: Oct. 12, 2021

(54) CONNECTOR

(71) Applicants: YAZAKI CORPORATION, Tokyo (JP); HONDA MOTOR CO., LTD., Tokyo (JP)

(72) Inventors: Kazuyuki Iwashita, Wako (JP); Taro Shimizu, Wako (JP); Naoki Kobayashi, Makinohara (JP); Ryosuke Ohfuku, Makinohara (JP); Yoshinori Hirayama, Sagamihara (JP)

(73) Assignees: YAZAKI CORPORATION, Tokyo (JP); HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/893,298

(22) Filed: Jun. 4, 2020

(65) Prior Publication Data

US 2020/0388949 A1 Dec. 10, 2020

(30) Foreign Application Priority Data

Jun. 4, 2019 (JP) ..... JP2019-104555

(51) Int. Cl.
*H01R 13/502* (2006.01)
*H01R 24/20* (2011.01)
*H01R 13/533* (2006.01)

(52) U.S. Cl.
CPC ..... *H01R 13/502* (2013.01); *H01R 13/533* (2013.01); *H01R 24/20* (2013.01)

(58) Field of Classification Search
CPC ..... H01R 13/64; H01R 13/03; H01R 13/633; H01R 43/18
See application file for complete search history.

(56) References Cited

U.S. PATENT DOCUMENTS 5,591,041 A * 1/1997 Cecil, Jr. ..... H01R 13/639 439/352
6,893,277 B2 * 5/2005 Parrish ..... H01R 13/506 439/188
8,545,262 B2 * 10/2013 Schmidt ..... H01R 13/7032 439/507
9,054,457 B2 * 6/2015 Odorfer ..... F42B 3/26
9,172,187 B2 * 10/2015 Miyakawa ..... H01R 13/639
(Continued)

FOREIGN PATENT DOCUMENTS

JP 2003-203722 A 7/2003
JP 6023580 B2 11/2016

*Primary Examiner* — Tho D Ta
*Assistant Examiner* — Nader J Alhawamdeh
(74) *Attorney, Agent, or Firm* — Kenealy Vaidya LLP

(57) ABSTRACT

A connector includes a housing formed with a L-shape in a side view having a connection portion capable of fitting to a mating connector, a terminal mounted on the housing by inserting a connection terminal portion into a terminal accommodation portion of the connection portion, an electric wire connected to the electric wire of the terminal and led out from the housing, a ferrite core mounted on the electric wire and assembled from the rear side of the housing, and a cover mounted on the rear surface of the housing and covering the terminal and the ferrite core. The cover includes a recessed portion, which receives an end portion of the ferrite core inclined by an external impact, on a facing surface facing the ferrite core assembled to the housing.

14 Claims, 14 Drawing Sheets

(56) References Cited

U.S. PATENT DOCUMENTS

| | | | | |
|---|---|---|---|---|
| 9,209,561 | B2 * | 12/2015 | Miyakawa | H01R 13/641 |
| 2002/0081888 | A1 * | 6/2002 | Regnier | H01R 13/639<br>439/352 |
| 2002/0115336 | A1 * | 8/2002 | Gunreben | H01R 13/5829<br>439/468 |
| 2004/0248454 | A1 * | 12/2004 | Gunreben | H01R 13/639<br>439/352 |
| 2005/0048843 | A1 * | 3/2005 | Iida | H01R 13/7197<br>439/620.07 |
| 2007/0105442 | A1 * | 5/2007 | Gunreben | H01R 13/506<br>439/607.01 |
| 2012/0112762 | A1 * | 5/2012 | Odorfer | H01R 13/7033<br>324/538 |
| 2013/0252455 | A1 * | 9/2013 | Gunreben | H01R 4/48<br>439/370 |
| 2014/0045361 | A1 * | 2/2014 | Gunreben | H01R 13/6275<br>439/345 |
| 2014/0287611 | A1 * | 9/2014 | Gunreben | H01R 13/641<br>439/354 |
| 2015/0111409 | A1 * | 4/2015 | Miyakawa | H01R 13/6273<br>439/357 |
| 2020/0388949 | A1 * | 12/2020 | Iwashita | H01R 13/533 |
| 2020/0388950 | A1 * | 12/2020 | Shimizu | H01R 13/7193 |

* cited by examiner

CONNECTOR

CROSS-REFERENCE TO RELATED APPLICATIONS

This application is based on and claims priority under 35 USC 119 from Japanese Patent Application No. 2019-104555 filed on Jun. 4, 2019, the contents of which are incorporated herein by reference.

TECHNICAL FIELD

The present invention relates to a connector.

BACKGROUND ART

For example, a connector on a harness side for connecting a wire harness to an inflator of an airbag system of an automobile is provided with a housing having a connection portion that is fitted and connected to a mating connector provided in the inflator (see, for example, Patent Literatures 1 and 2). The housing of the connector includes a ferrite accommodation portion covered with a cover, and a ferrite core mounted to an electric wire of the wire harness as a noise filter is accommodated in the ferrite accommodation portion.

CITATION LIST

Patent Literature

Patent Literature 1: JP-A-2003-203722
Patent Literature 2: Japanese Patent No. 6023580

SUMMARY OF INVENTION

When the inflator is activated and the airbag is deployed, a large impact force is applied to the connector, and the ferrite core accommodated in the ferrite accommodation portion of the housing of the connector is largely swung. Although the connector having the above structure includes a rib that locks an end portion of the ferrite core at an edge portion of the housing on a side from which the electric wire is led out, when the heavy ferrite core is largely swung, the ferrite core may get over the rib of the housing and slip out of the ferrite accommodation portion. Further, not only when the airbag is deployed, but also an external impact is applied to the connector, the ferrite core may slip out of the ferrite accommodation portion in the same manner as described above.

The present invention has been made in view of the above circumstances, and an object thereof is to provide a connector capable of maintaining a ferrite core in a state of being accommodated in a housing and maintaining a required performance even when an external impact is applied.

In order to achieve the above object, the connector according to the present invention is characterized by the following (1) to (5).

(1) A connector connected to a mating connector, the connector including:

a housing that has a connection portion protruding toward a front side being a connection side with the mating connector and being capable of fitting to the mating connector, and of which a rear side is opened, a terminal that includes a connection terminal portion and an electric wire connection portion, and that is mounted to the housing by inserting the connection terminal portion into a terminal accommodation portion formed in the connection portion:

an electric wire connected to the electric wire connection portion of the terminal and led out from the housing;

a ferrite core mounted to the electric wire and assembled from the rear side of the housing; and a cover mounted to a rear surface of the housing and covering the terminal and the ferrite core assembled to the housing, wherein the cover includes a recessed portion, which receives an end portion of the ferrite core inclined by an external impact, on a facing surface facing the ferrite core assembled to the housing.

(2) The connector according to (1), wherein an edge portion of the recessed portion on a connection portion side is disposed between the connection portion and a center of gravity of the ferrite core, and is a fulcrum of the ferrite core when the ferrite core is inclined toward a recessed portion side by the external impact.

(3) The connector according to (1), wherein the housing includes a protrusion portion that protrudes toward a cover side and locks an end portion of the ferrite core, at an edge portion on a leading-out side of the electric wire, and wherein the protrusion portion includes a guide surface that is inclined toward the cover side toward the leading-out side of the electric wire.

(4) The connector according to (3), wherein the protrusion portion includes a tapered surface that is inclined toward the cover side toward the connection portion side.

(5) The connector according to (3), wherein the housing includes a plurality of slits that are formed along a leading-out direction of the electric wire and divide the protrusion portion.

According to the connector having the above configuration (1), when a large acceleration is applied to the heavy ferrite core due to the external impact, the ferrite core is inclined and the end portion thereof is received by the recessed portion of the cover. As a result, the ferrite core subjected to the impact can be suppressed from slipping out of the housing from the leading-out side of the electric wire, and a required performance can be maintained.

According to the connector having the above configuration (2), when the large acceleration is applied to the ferrite core due to the external impact, the ferrite core can be pivoted around the fulcrum formed by the edge portion of the recessed portion, and the ferrite core can be smoothly inclined. As a result, the end portion of the ferrite core can be smoothly guided to the recessed portion of the cover, and can be received.

According to the connector having the above configuration (3), the end portion of the ferrite core is locked to the protrusion portion, so that the effect of preventing the ferrite core from coming off the housing can be further enhanced. Moreover, when the ferrite core is displaced due to the external impact, the ferrite core is pushed out to and guided to the recessed portion of the cover by the guide surface of the protrusion portion. As a result, the end portion of the ferrite core can be smoothly guided to the recessed portion of the cover, and can be more reliably received.

According to the connector having the above configuration (4), when the ferrite core is moved along the electric wire and assembled to the rear surface of the housing after the terminal is assembled to the housing, the ferrite core is smoothly guided to the rear surface of the housing by the tapered surface. As a result, assembling workability of the ferrite core can be improved.

According to the connector having the above configuration (5), the protrusion portion is divided by the plurality of slits formed on the housing, and flexibility is enhanced. Therefore, when the ferrite core is moved along the electric wire and assembled to the rear surface of the housing, the protrusion portion against which the ferrite core abuts is easily elastically deformed.

As a result, the assembling workability of the ferrite core can be improved.

According to the present invention, it is possible to provide a connector capable of maintaining the ferrite core in a state of being accommodated in the housing and maintaining the required performance even when the external impact is applied.

The present invention has been briefly described above. Details of the present invention will be further clarified by reading a mode (hereinafter, referred to as an "embodiment") for carrying out the present invention described below with reference to the accompanying drawings.

BRIEF DESCRIPTION OF DRAWINGS

FIG. 13A is a longitudinal sectional view of a part of the connector before an airbag is deployed, and FIG. 13B is a longitudinal sectional view of a part of the connector when the airbag is deployed.

FIG. 14A is a longitudinal sectional view of a part of the connector before the airbag is deployed, and FIG. 14B is a longitudinal sectional view of a part of the connector when the airbag is deployed.

DESCRIPTION OF EMBODIMENTS

Figure 1:
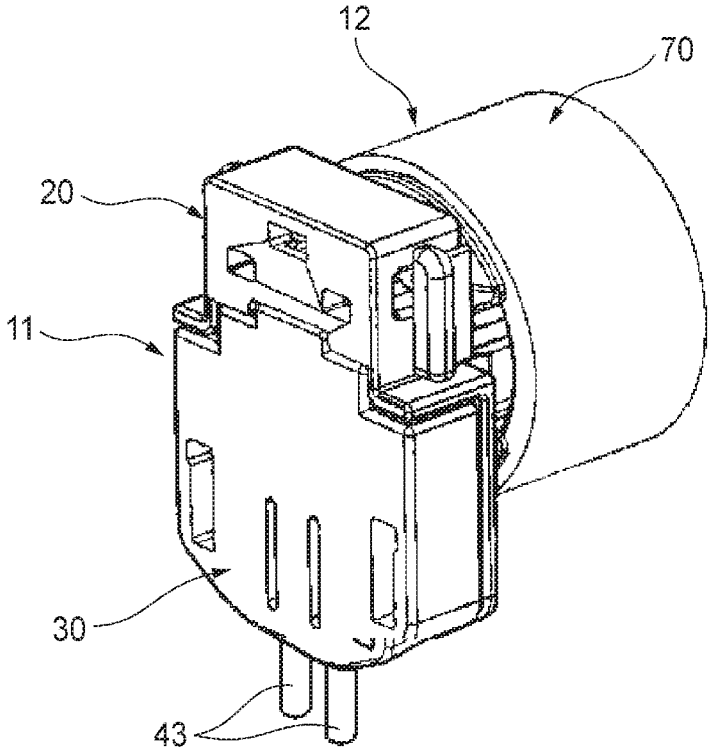
FIG. 1 is a perspective view of a connector according to an embodiment connected to a mating connector.
Figure 2:
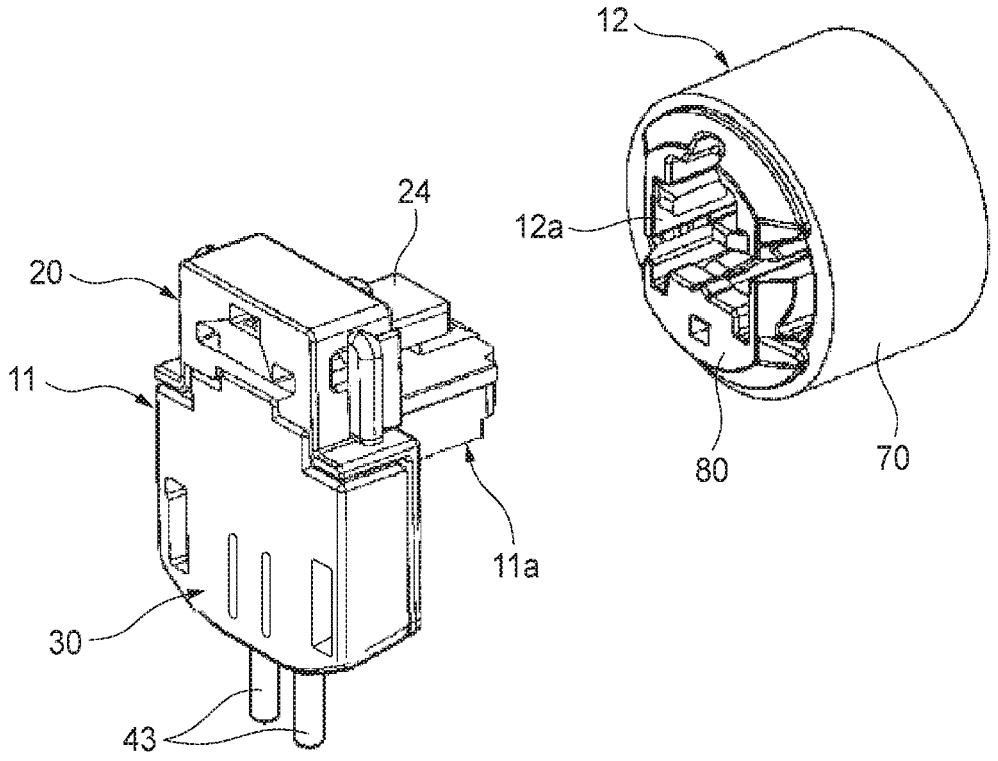
FIG. 2 is a perspective view of the connector according to the present embodiment and the mating connector as viewed from a rear side.
Figure 3:
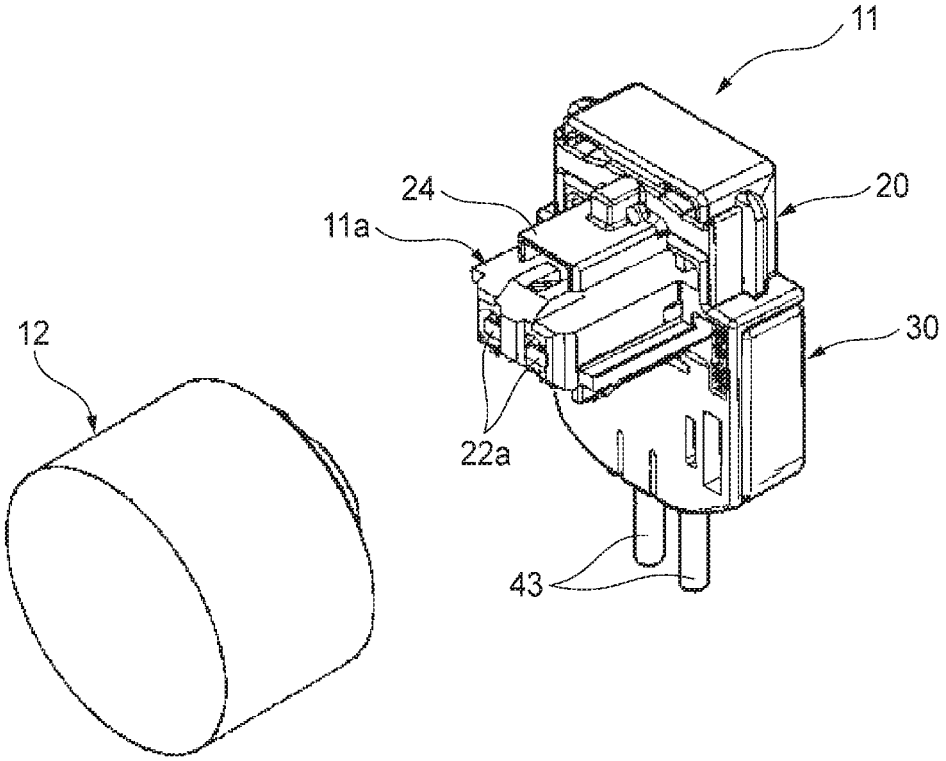
FIG. 3 is a perspective view of the connector according to the present embodiment and the mating connector as viewed from a front side.
Figure 4:
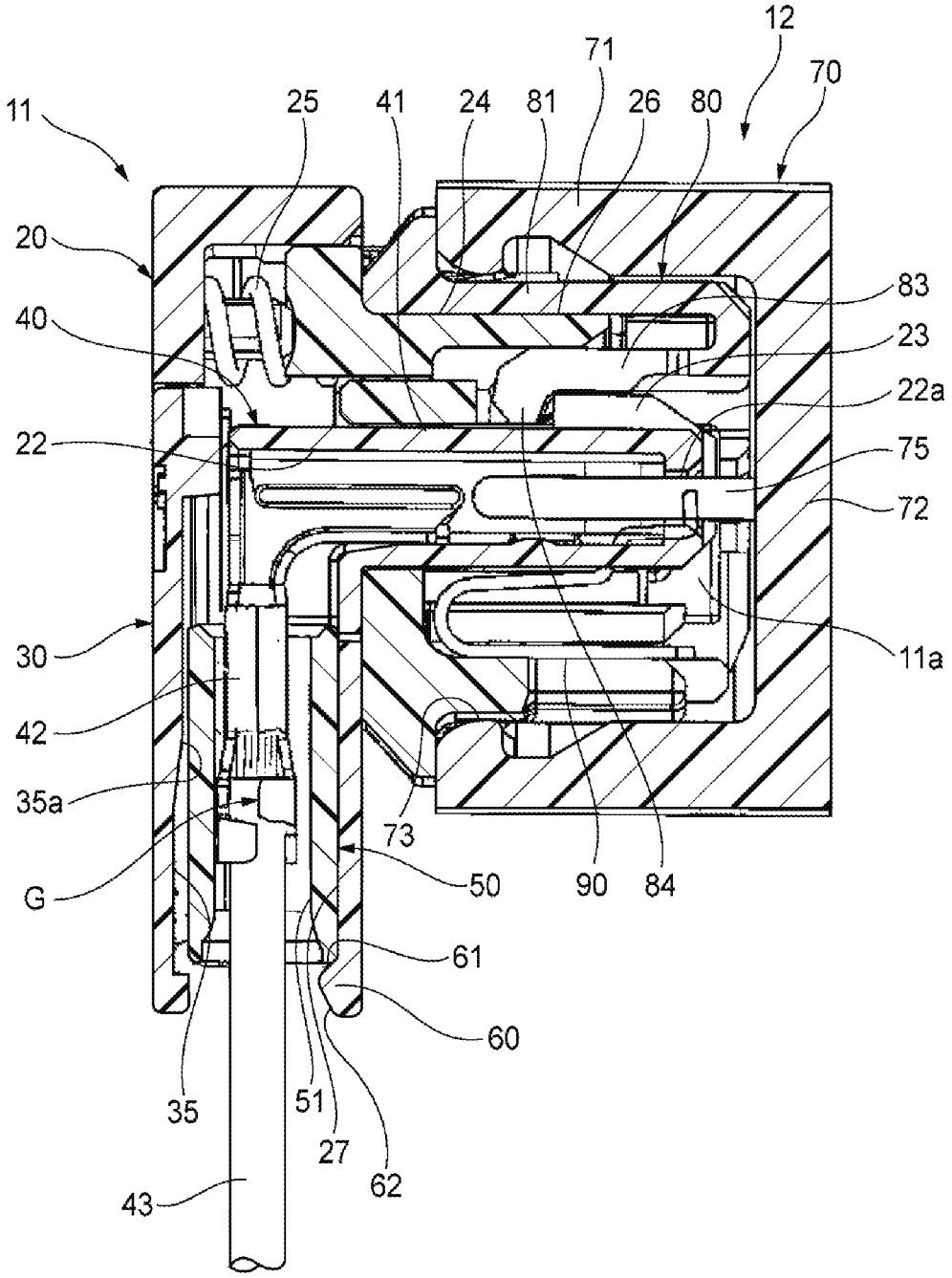
FIG. 4 is a longitudinal sectional view of the connector and the mating connector connected to each other.

Hereinafter, an embodiment of the present invention will be described with reference to the drawings. FIG. 1 is a perspective view of a connector according to the present embodiment connected to a mating connector. FIG. 2 is a perspective view of the connector according to the present embodiment and the mating connector as viewed from a rear side. FIG. 3 is a perspective view of the connector according to the present embodiment and the mating connector as viewed from a front side. FIG. 4 is a longitudinal sectional view of the connector and the mating connector connected to each other.

As shown in FIGS. 1 to 4, a connector 11 according to the present embodiment is connected to a mating connector 12. The connector 11 and the mating connector 12 form an electrical connector of an in-vehicle airbag system provided in an automobile or the like. The connector 11 is a connector on a wire harness side, and the mating connector 12 is a connector on an inflator side provided in an inflator of the airbag system.

The connector 11 has a connection portion 11*a*, and the mating connector 12 has a fitting opening 12*a*. The connector 11 is connected to the mating connector 12 by fitting the connection portion 11*a* into the fitting opening 12*a* of the mating connector 12.

Figure 5:
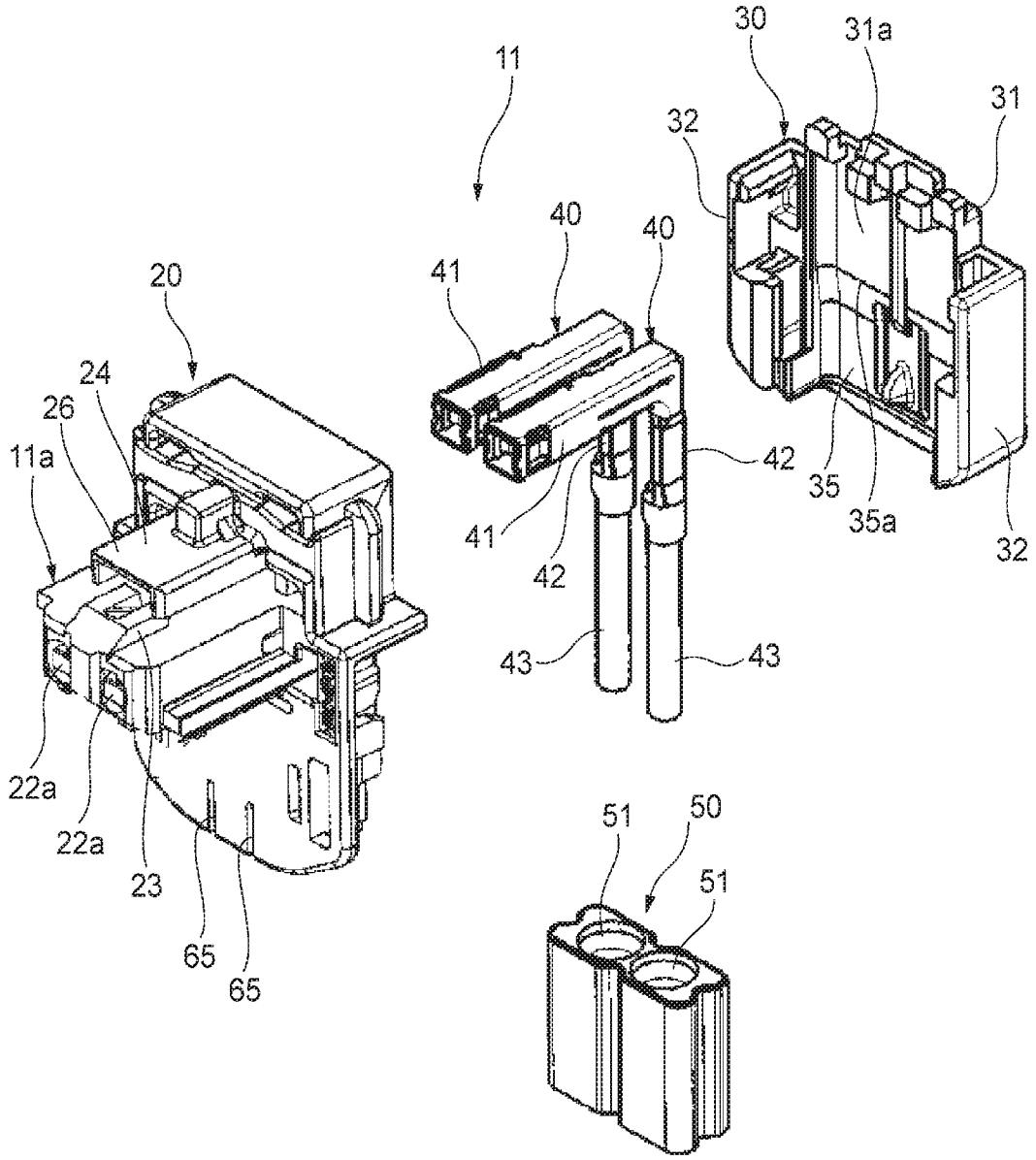
FIG. 5 is an exploded perspective view of the connector according to the present embodiment.

FIG. 5 is an exploded perspective view of the connector according to the present embodiment. As shown in FIG. 5, the connector 11 includes a housing 20, a cover 30, terminals 40, and a ferrite core 50.

The housing 20 is formed of a synthetic resin, and the connection portion 11*a* is integrally formed. The connection portion 11*a* is provided on one end side of the housing 20 so as to protrude toward a front side of the housing 20 that is a connection side with the mating connector 12. As a result, the housing 20 is formed in an L-shape in a side view. In addition, a locking protrusion 23 protruding upward is formed on an upper portion of the connection portion 11*a* on a distal end side. The housing 20 includes a slider 24. The slider 24 is provided on the upper portion of the connection portion 11*a*, and is urged toward the front side by a coil spring 25. A locking piece 26 protruding forward is formed on the slider 24.

As shown in FIG. 3, a pair of terminal accommodation chambers 22 are formed in the connection portion 11*a* of the housing 20. The terminal accommodation chambers 22 are formed along an extending direction of the connection portion 11*a*. Insertion holes 22*a* communicating with the terminal accommodation chambers 22 are formed at a distal end of the connection portion 11*a*.

A rear side of the housing 20 is opened, and the cover 30 is mounted to the opened rear side. The housing 20 has, on a rear surface thereof, a core accommodation portion 27 to which the ferrite core 50 is mounted.

The cover 30 is formed of a synthetic resin, and is mounted to the housing 20 from the rear side. The cover 30 has a plate-like portion 31 and side wall portions 32 formed on both sides of the plate-like portion 31. Each of the side wall portions 32 projects from the plate-like portion 31 toward a mounting side to the housing 20. As a result, the cover 30 is formed in a concave shape in which the mounting side to the housing 20 is concave. The cover 30 is mounted to the housing 20 so as to cover the rear surface of the housing 20 including the core accommodation portion 27.

The terminal 40 is formed of a conductive metal material, and is formed in an L shape in a side view. The terminal 40 includes connection terminal portions 41 and electric wire connection portions 42, and electric wires 43 of wire harnesses are connected to the electric wire connection portions 42. The connection terminal portions 41 of the terminals 40 are each formed in a box shape with an open distal end, and pins 75 of the mating connector 12 are inserted from distal end sides. As a result, the pin 75 and the terminal 40 are conductively connected.

The ferrite core 50 is mounted to the electric wire 43 of the wire harness. The ferrite core 50 is a component in which a ferromagnetic material of a metal oxide is formed in a block shape, and is a noise countermeasure component that prevents a noise current from flowing through the electric wire 43 due to various electromagnetic waves from the outside. The ferrite core 50 is formed in a substantially rectangular parallelepiped shape, and is formed with two insertion holes 51 along a longitudinal direction thereof. The ferrite core 50 is mounted to the electric wire 43 by passing the electric wire 43 through the insertion hole 51.

In the connector 11, the terminal 40 and the ferrite core 50 are mounted to the housing from the rear side. The terminal 40 is mounted to the housing 20 by inserting the connection terminal portion 41 into the terminal accommodation chamber 22 formed in the connection portion 11*a* from the rear side of the housing 20. The ferrite core 50 is mounted to the core accommodation portion 27 of the housing 20 in a state in which the electric wire 43 is passed through the insertion hole 51.

By mounting the cover 30 to the housing 20 in a state in which the terminal 40 and the ferrite core 50 are mounted to the housing 20, the terminal 40 and the ferrite core 50 are held in the state in which the terminal 40 and the ferrite core 50 are mounted to the housing 20. Further, the electric wire 43 passed through the insertion hole 51 of the ferrite core 50 is led out from a lower end of the housing 20.

The mating connector 12 includes a holder 70 and a shunt ring 80. The holder 70 is formed in a bottomed cylindrical shape having a cylindrical portion 71 formed in a cylindrical shape and a bottom portion 72 provided on one side of the cylindrical portion 71, and a fitting side to the connector 11 is an opening portion 73. The two pins 75 are fixed to the bottom portion 72 of the holder 70 at an interval, and these pins 75 extend toward the opening portion 73 side. The pin 75 is formed of a conductive metal material, and is connected to a circuit on the inflator side of the airbag system.

The shunt ring 80 is formed of a synthetic resin. The shunt ring 80 has a main body portion 81, and the fitting opening 12*a* is formed in the main body portion 81. Further, the connection portion 11*a* of the housing 20 is fitted into the fitting opening 12*a*. In the shunt ring 80, the main body portion 81 is fitted into and mounted to the holder 70 from the opening portion 73. When the shunt ring 80 is mounted to the holder 70, the main body portion 81 is accommodated in the holder 70 so as to surround the pin 75. When the shunt ring 80 is mounted to the holder 70, the pin 75 is disposed in the fitting opening 12*a* of the main body portion 81.

The shunt ring 80 includes a lock portion 83. The lock portion 83 includes a locking claw 84 at a distal end thereof. The locking claw 84 at the distal end of the lock portion 83 locks the locking protrusion 23 formed on the connection portion 11*a* of the housing 20.

The shunt ring 80 includes a short terminal 90. The short terminal 90 is formed of a conductive metal material, and is formed in a U-shape in a side view provided with a contact point (not shown). The short terminal 90 is mounted and held in the shunt ring 80. In the mating connector 12, the contact point of the short terminal 90 is in contact with the pin 75 in a state in which the connector 11 is not fitted. As a result, the pins 75 are made conductive with each other at the short terminal 90, and the circuit on the inflator side is short-circuited. Accordingly, for example, in the circuit on the inflator side, a warning light is turned on to warn that the connector 11 is not properly fitted to the mating connector 12.

In order to fit the connector 11 to the mating connector 12, the connection portion 11*a* of the connector 11 is inserted into the fitting opening 12*a* of the mating connector 12. In this way, the pin 75 of the mating connector 12 is inserted into the insertion hole 22*a*. Accordingly, the pin 75 is inserted into the connection terminal portion 41 of the terminal 40, and the pin 75 and the terminal 40 are electrically connected.

When the connection portion 11*a* of the connector 11 is inserted into the fitting opening 12*a* of the mating connector 12, the locking claw 84 of the lock portion 83 of the shunt ring 80 locks the locking protrusion 23 formed on the connection portion 11*a* of the housing 20. This maintains a fitted state of the connector 11 and the mating connector 12. In this state, the locking piece 26 of the slider 24 urged forward of the housing 20 by the coil spring 25 enters an opposite side of the locking protrusion 23 with respect to the lock portion 83. Therefore, detachment of the locking claw 84 from the locking protrusion 23 due to elastic deformation of the lock portion 83 is prohibited. As a result, a locked state of the locking protrusion 23 by the locking claw 84 of the lock portion 83 is maintained, and the connector 11 and the mating connector 12 are maintained in a connected state.

When the connector 11 is fitted to the mating connector 12, a wall portion of the resin connection portion 11*a* enters between the pin 75 and the contact point of the short terminal 90 that are in contact with each other. As a result, the contact point of the short terminal 90 is separated from the pin 75, a conduction state between the pins 75 is released, and a short-circuit state of the circuit on the inflator side is released. Accordingly, for example, in the circuit on the inflator side, it is confirmed that the connector 11 is normally fitted to the mating connector 12 when the warning light is turned off.

Figure 6:
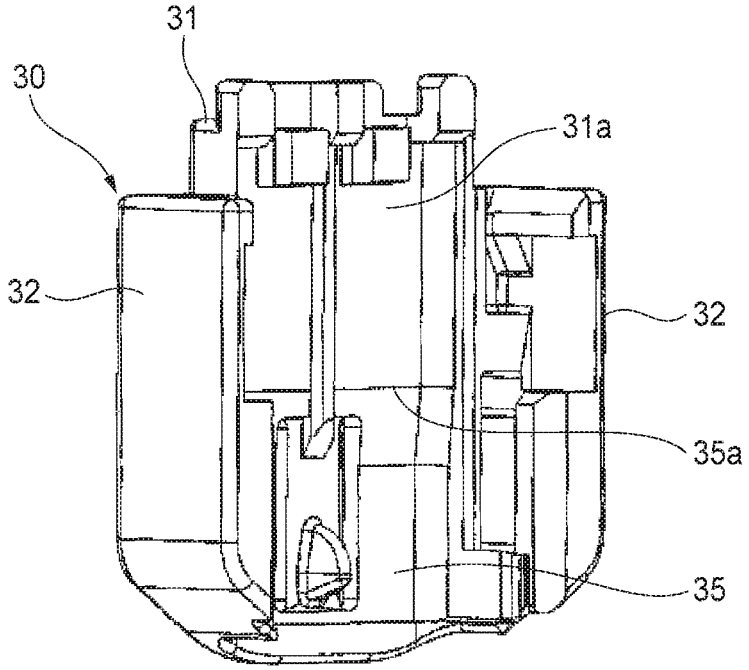
FIG. 6 is a perspective view of a cover of the connector as viewed from a mounting side to a housing.
Figure 7:
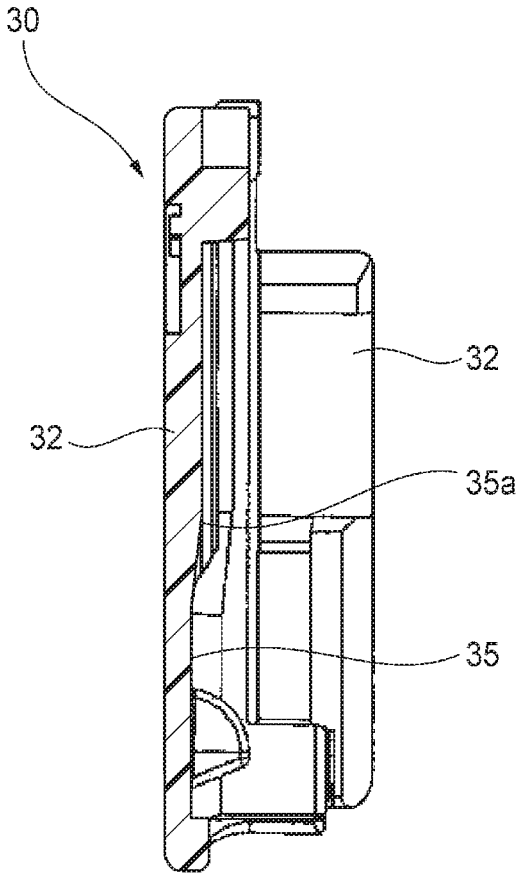
FIG. 7 is a longitudinal sectional view of the cover of the connector.

FIG. 6 is a perspective view of the cover of the connector as viewed from the mounting side to the housing. FIG. 7 is a longitudinal sectional view of the cover of the connector. As shown in FIGS. 6 and 7, in the connector 11 having the above structure, in the present embodiment, the cover 30 includes a recessed portion 35 in the plate-like portion 31. The recessed portion 35 is formed on a facing surface 31*a* facing the ferrite core 50 assembled to the core accommodation portion 27 of the housing 20 in the state in which the cover 30 is mounted to the housing 20. In addition, the recessed portion 35 is formed on a side of the facing surface 31*a* from which the electric wire 43 is led out. An edge portion of the recessed portion 35 on a connection portion 11*a* side is a fulcrum 35*a*. The edge portion of the recessed portion 35 formed as the fulcrum 35*a* is disposed between the connection portion 11*a* and a center of gravity G of the ferrite core 50 (see FIG. 4).

Figure 8:
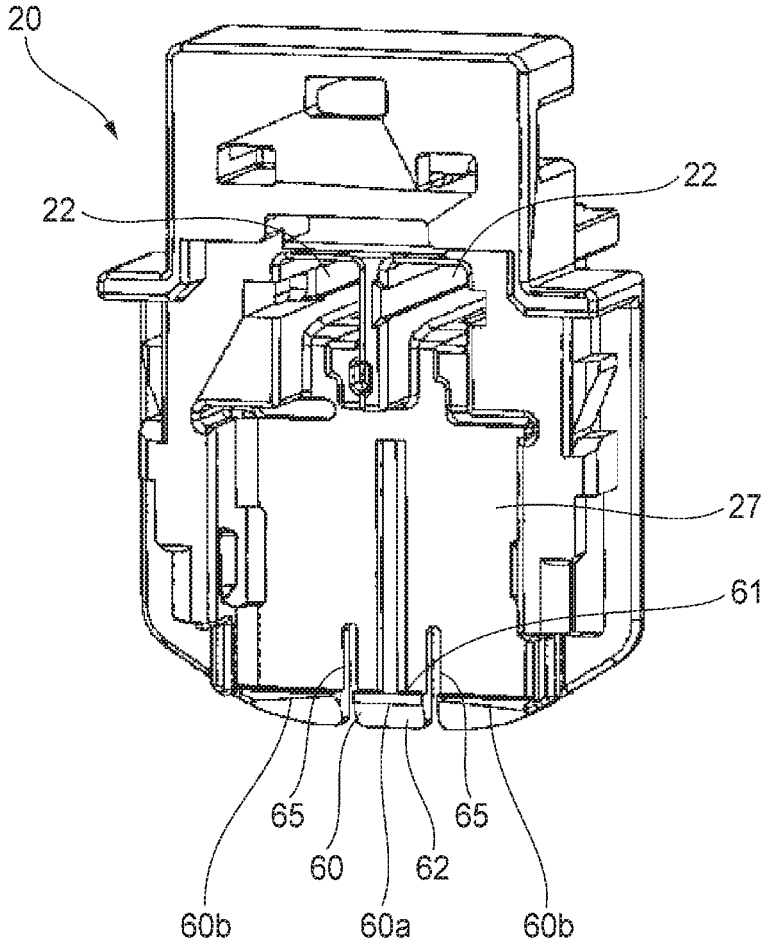
FIG. 8 is a perspective view of the housing of the connector as viewed from the rear side.
Figure 9:
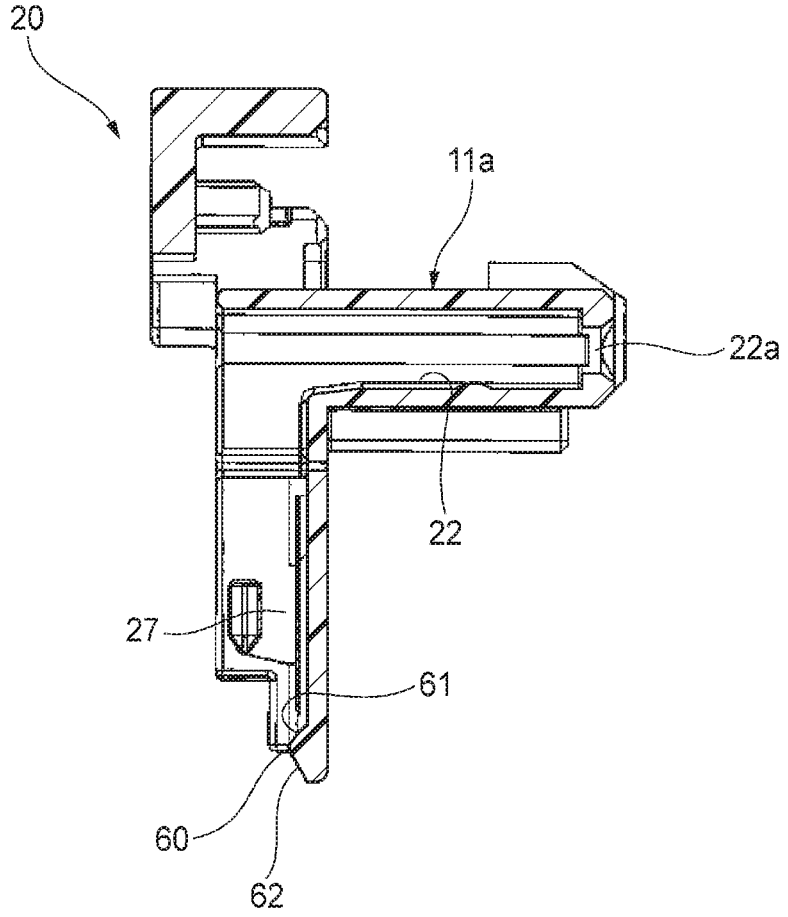
FIG. 9 is a longitudinal sectional view of the housing of the connector.
Figure 10:
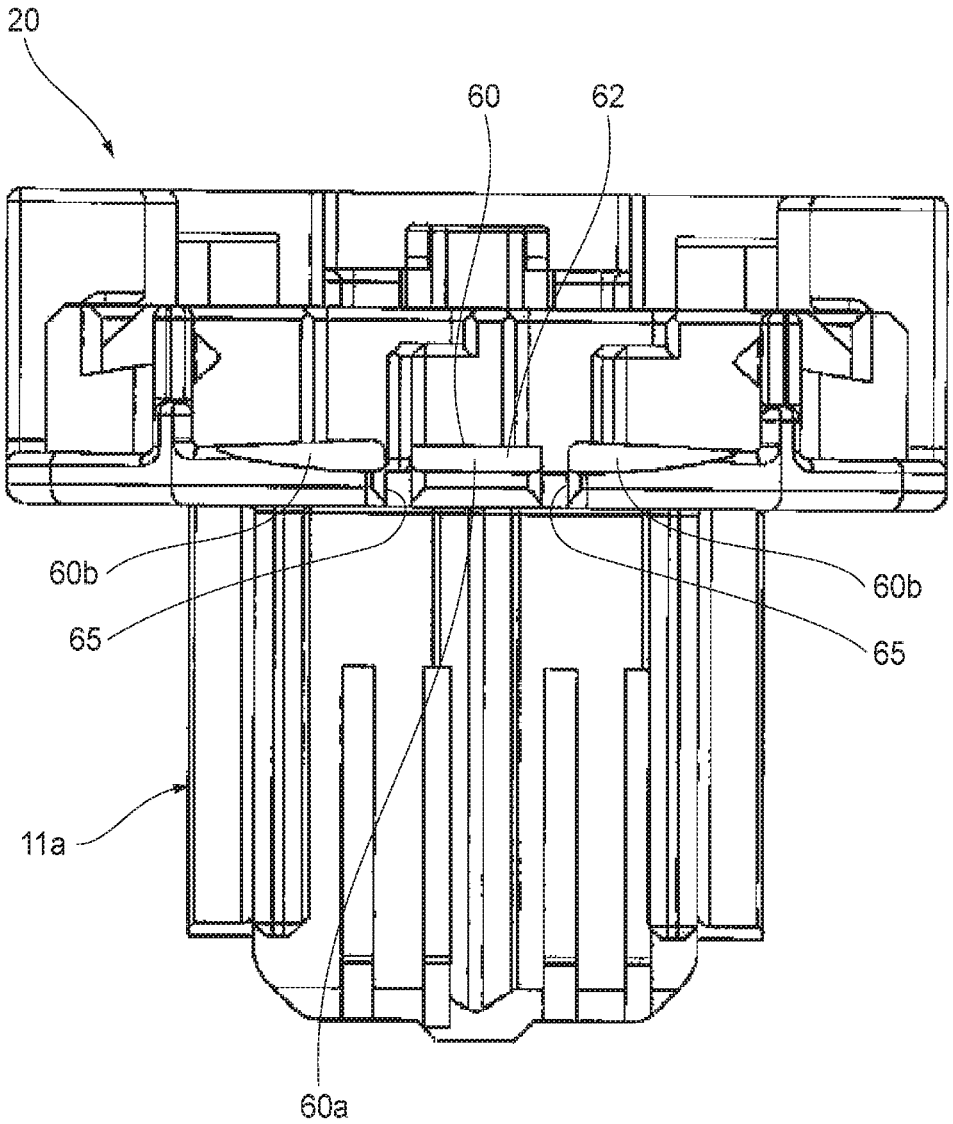
FIG. 10 is a bottom view of the housing of the connector.

FIG. 8 is a perspective view of the housing of the connector as viewed from the rear side. FIG. 9 is a longitudinal sectional view of the housing of the connector. FIG. 10 is a bottom view of the housing of the connector. As shown in FIGS. 8 to 10, the housing 20 is provided with a protrusion portion 60 protruding toward the cover 30 side at an edge portion on the leading-out side of the electric wire 43. The protrusion portion 60 locks an end portion of the ferrite core 50 mounted to the core accommodation portion 27 of the housing 20. The protrusion portion 60 includes a guide surface 61 on a core accommodation portion 27 side. The guide surface 61 is an inclined surface of the housing 20 that is inclined toward the cover 30 side toward the leading-out side of the electric wire 43. Further, the protrusion portion 60 includes a tapered surface 62 on the opposite side to the core accommodation portion 27. The tapered surface 62 is an inclined surface that is inclined toward the cover 30 side toward a connection portion 11*a* side.

The housing 20 includes a plurality of slits 65 at an end portion on the leading-out side of the electric wire 43. The slits 65 are formed along a leading-out direction of the electric wire 43, and the protrusion portion 60 is divided into a plurality of parts in a width direction by these slits 65. Specifically, the protrusion portion 60 is divided into a central protrusion portion 60*a* and side protrusion portions 60*b* disposed on both sides of the central protrusion portion 60*a* by forming the two slits 65. A protruding dimension of each side protrusion portion 60*b* gradually decreases toward the side of the housing 20 (see FIG. 10).

Next, an assembling procedure of the connector 11 will be described.

Figure 11A:
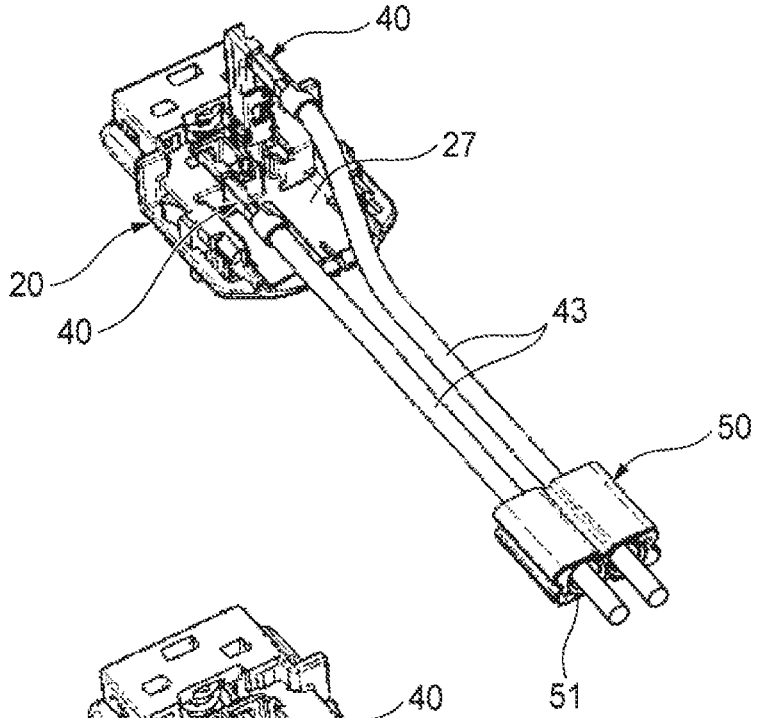
FIGS. 11A to 11C are views for explaining an assembling procedure of the connector, and are perspective views of the connector during assembly, respectively.
Figure 11B:
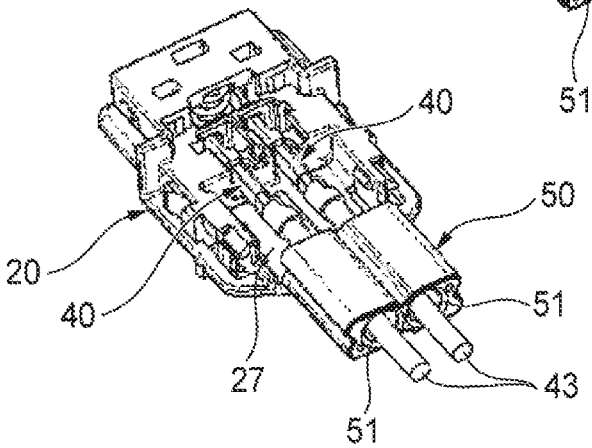
Figure 11C:
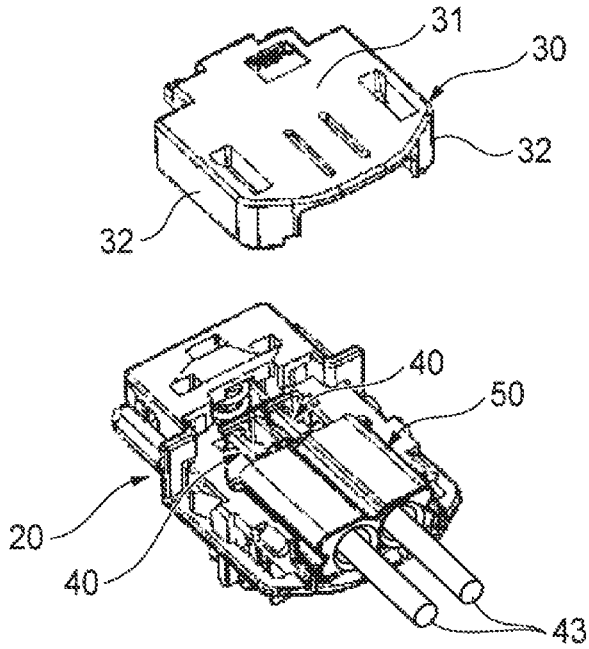
Figure 12:
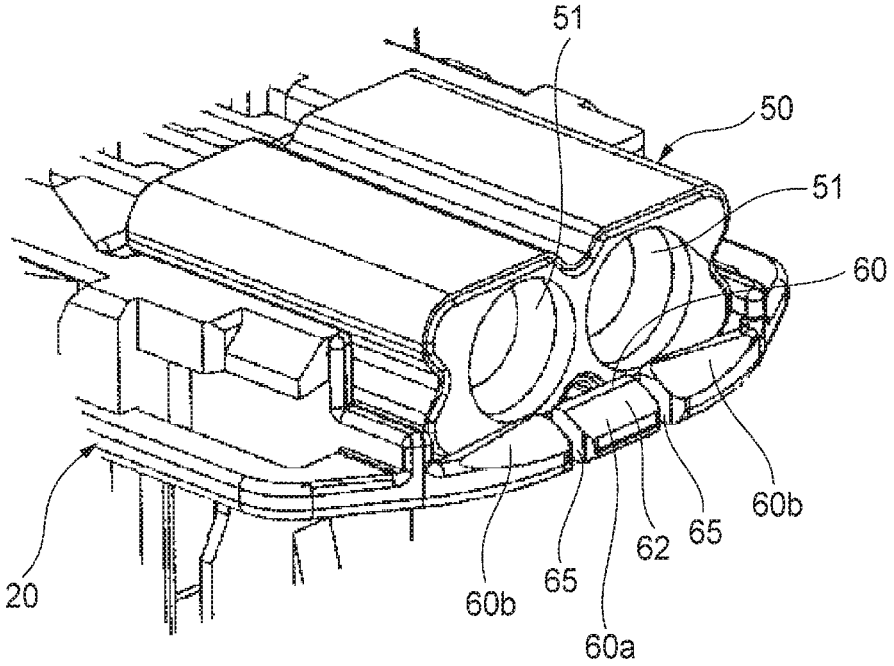
FIG. 12 is a perspective view of the housing in a state in which the ferrite core is mounted, as viewed from a leading-out side of an electric wire.

FIG. 1 is a view for explaining the assembling procedure of the connector, in which FIGS. 11A to 11C are perspective views of the connector during assembly, respectively. FIG. 12 is a perspective view of the housing in a state in which the ferrite core is mounted, as viewed from the leading-out side of the electric wire.

As shown in FIG. 11A, first, the terminal 40 is assembled to the housing 20. Specifically, the connection terminal portion 41 of the terminal 40 to which the electric wire 43 is connected is inserted into the terminal accommodation chamber 22 of the connection portion 11*a* from the rear side of the housing 20. Accordingly, the terminal 40 is mounted to the housing 20, and the electric wire 43 connected to the electric wire connection portion 42 of the terminal 40 is led out from another end side opposite to the connection portion 11*a* of the housing 20 through the core accommodation portion 27 of the housing 20.

As shown in FIG. 11B, by passing the electric wire 43 through the insertion hole 51 in advance, the ferrite core 50 mounted to the electric wire 43 is slid toward the housing 20 side and is disposed in the core accommodation portion 27. At this time, the end portion of the ferrite core 50 on a front side in a mounting direction to the housing 20 abuts against the protrusion portion 60 of the housing 20. Then, as shown in FIG. 12, the ferrite core 50 slides on the tapered surface 62 of the protrusion portion 60 and gets over the protrusion portion 60, and is guided to the core accommodation portion 27 of the housing 20. In addition, the protrusion portion 60 is divided into the plurality of parts by the slit 65, and flexibility is enhanced. Therefore, when the ferrite core 50 is slid and mounted to the housing 20, the protrusion portion 60 is easily elastically deformed. In particular, the central protrusion portion 60*a* having a high protruding height is easily elastically deformed since the slits 65 are formed on both sides thereof. Since the side protrusion portion 60*b* has no slit 65 on an opposite side to the central protrusion portion 60*a*, the side protrusion portion 60*b* has higher rigidity than the central protrusion portion 60*a* and is less likely to be elastically deformed. However, since the protruding dimension of the side protrusion portion 60*b* gradually decreases toward the side of the housing 20, catching of the ferrite core 50 on the side protrusion portion 60*b* is suppressed.

As shown in FIG. 11C, when the terminal 40 and the ferrite core 50 are mounted to the housing 20, the cover 30 is put on and mounted to the housing 20 from the rear side. As a result, the terminal 40 and the ferrite core 50 are held in a state of being mounted to the housing 20, and the electric wire 43 passed through the insertion hole 51 of the ferrite core 50 is led out from the lower end of the housing 20.

When an inflator is activated and the airbag is deployed in a state in which the connector 11 having the above structure is connected to the mating connector 12, a large impact force is applied to the connector 11, so that the connector 11 is largely swung with a connection point between the mating connector 12 and the connection portion 11*a* as a fulcrum.

Next, a movement of the ferrite core 50 when the airbag is deployed will be described. FIG. 13 shows a movement of a ferrite core in a connector according to a reference example, and FIG. 14 shows the movement of the ferrite core in the connector according to the present embodiment.

Figure 13A:
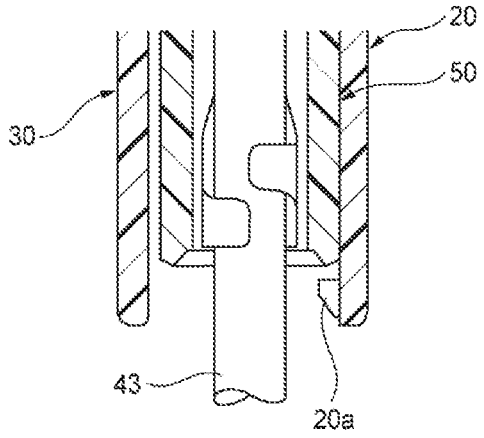
FIGS. 13A and 13B are views showing a movement of a ferrite core in a connector according to a reference example.

As shown in FIG. 13A, in the reference example, the cover 30 without the recessed portion 35 is mounted to the housing 20 in the housing 20. In addition, the housing 20 includes a rib 20*a* protruding toward the cover side at an edge portion of the leading-out side of the electric wire 43. In the reference example, as shown in FIG. 13A, the ferrite core 50 is locked to the rib 20*a* at normal time, so that the ferrite core 50 is prevented from coming off the housing 20.

Figure 13B:
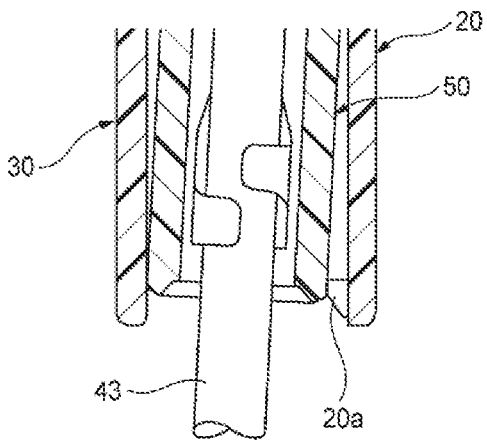

In the connector of the reference example, when the inflator is activated to deploy the airbag and an impact is applied, the ferrite core 50 is swung largely. Further, as shown in FIG. 13B, the ferrite core 50 may get over the rib 20*a* of the housing 20 and slip out of an end portion on the leading-out side of the electric wire 43.

Figure 14A:
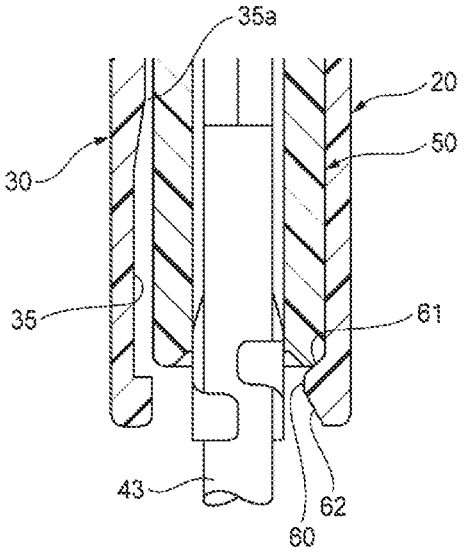
FIGS. 14A and 14B are views showing a movement of the ferrite core in the connector according to the present embodiment.

In the present embodiment, as shown in FIG. 14A, the ferrite core 50 is locked to the protrusion portion 60 at normal time, so that the ferrite core 50 is prevented from coming off the housing 20.

Figure 14B:
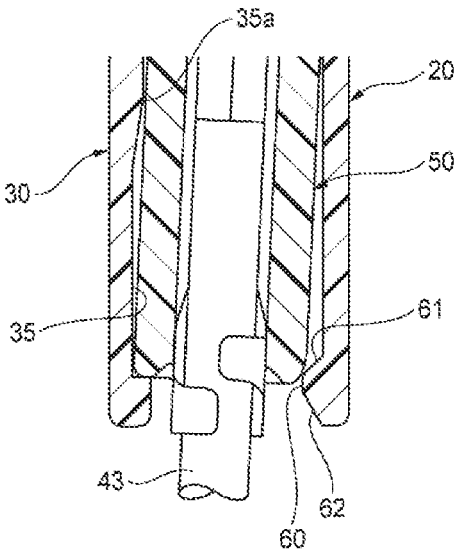

In the connector 11 of the present embodiment, when the inflator is activated to deploy the airbag and the impact is applied, the ferrite core 50 is swung largely. Further, as shown in FIG. 14B, the ferrite core 50 is inclined by an applied large acceleration, and the end portion of the ferrite core 50 on the leading-out side of the electric wire 43 enters the recessed portion 35 of the cover 30 and is received. As a result, the ferrite core 50 subjected to the impact is suppressed from slipping out of the housing 20 from the end portion on the leading-out side of the electric wire 43.

The ferrite core 50 pivots around the fulcrum 35*a* formed by the edge portion of the recessed portion 35 on the connection portion 11*a* side, which is disposed between the connection portion 11*a* and the center of gravity G of the ferrite core 50, and is easily inclined. As a result, the end portion of the ferrite core 50 is smoothly guided to the recessed portion 35 of the cover 30.

Further, the end portion of the ferrite core 50 abuts against the guide surface 61 of the protrusion portion 60 of the housing 20, so that the ferrite core 50 is pushed out toward the cover side along the guide surface 61. As a result, the end portion of the ferrite core 50 is smoothly guided to the recessed portion 35 of the cover 30.

As described above, according to the connector 11 according to the present embodiment, even if the large acceleration is applied to the heavy ferrite core 50 due to the impact when the airbag is deployed, the ferrite core 50 is inclined and the end portion thereof is received by the recessed portion 35 of the cover 30. As a result, the ferrite core 50 subjected to the impact can be suppressed from slipping out of the housing 20 from the leading-out side of the electric wire 43, and a required performance can be maintained.

Moreover, when the large acceleration is applied to the ferrite core 50 due to the impact when the airbag is deployed, the ferrite core 50 can be pivoted around the fulcrum 35*a* formed by the edge portion of the recessed portion 35, and the ferrite core 50 can be smoothly inclined. As a result, the end portion of the ferrite core 50 can be smoothly guided to the recessed portion of the cover 30, and can be received.

Further, the end portion of the ferrite core 50 is locked to the protrusion portion 60, so that the effect of preventing the ferrite core 50 from coming off the housing 20 can be further enhanced. Moreover, when the ferrite core 50 is displaced due to the impact at the time of deployment of the airbag, the ferrite core 50 is pushed out to and guided to the recessed portion of the cover 30 by the guide surface 61 of the protrusion portion 60. Accordingly, the end portion of the ferrite core 50 can be smoothly guided to the recessed portion 35 of the cover 30, and can be more reliably received.

After the terminal 40 is assembled to the housing 20, the ferrite core 50 is smoothly guided to the rear surface of the housing 20 by the tapered surface 62 when the ferrite core 50 is moved along the electric wire 43 and assembled to the rear surface of the housing 20. As a result, assembling workability of the ferrite core 50 can be improved.

The protrusion portion 60 is divided by the plurality of slits 65 formed on the housing 20, and the flexibility is enhanced. Therefore, when the ferrite core 50 is moved along the electric wire 43 and assembled to the rear surface of the housing 20, the protrusion portion 60 against which the ferrite core 50 abuts is easily elastically deformed. As a result, the assembling workability of the ferrite core 50 can be improved.

The present invention is not limited to the embodiment described above, and modifications, improvements, or the like can be made as appropriate. In addition, materials, shapes, dimensions, numbers, arrangement positions or the like of elements in the embodiment described above are optional and not limited as long as the present invention can be achieved.

For example, in the present embodiment, the connector 11 connected to the mating connector 12 provided on the inflator of the airbag system is exemplified, but the connector 11 is not limited to the one connected to the mating connector 12 provided on the inflator.

The characteristics of the embodiment of the connector according to the present invention will be briefly summarized in the following [1] to [5], respectively.

[1] A connector (11) connected to a mating connector (12), the connector including:

a housing (20) that includes a connection portion (11*a*) protruding toward a front side being a connection side with the mating connector and being capable of fitting to the mating connector (12), and of which a rear side is opened;

a terminal (40) including a connection terminal portion (41) and an electric wire connection portion (42), that is mounted to the housing (20) by inserting the connection terminal portion (41) into a terminal accommodation portion (22) formed in the connection portion (11*a*):

an electric wire (43) connected to the electric wire connection portion (42) of the terminal (40) and led out from the housing (20);

a ferrite core (50) mounted to the electric wire (43) and assembled from the rear side of the housing (20); and a cover (30) mounted to a rear surface of the housing (20) and covering the terminal (40) and the ferrite core (50) assembled to the housing (20), wherein the cover (30) includes a recessed portion (35), which receives an end portion of the ferrite core (50) inclined by an external impact, on a facing surface (31*a*) facing the ferrite core (50) assembled to the housing (20).

[2] The connector according to [1], wherein an edge portion of the recessed portion (35) on a connection portion (11*a*) side is disposed between the connection portion (11*a*) and a center of gravity (G) of the ferrite core (50), and is a fulcrum (35*a*) of the ferrite core (50) when the ferrite core (50) is inclined toward a recessed portion (35) side by the external impact.

[3] The connector according to [1], wherein the housing (20) includes a protrusion portion (60) that protrudes toward a cover (30) side and locks an end portion of the ferrite core (50), at an edge portion on a leading-out side of the electric wire (43), and wherein the protrusion portion (60) includes a guide surface (61) that is inclined toward the cover (30) side toward the leading-out side of the electric wire (43).

[4] The connector according to [3], wherein the protrusion portion (60) includes a tapered surface (62) that is inclined toward the cover (30) side toward the connection portion (11*a*) side.

[5] The connector according to [3], wherein the housing (20) includes a plurality of slits (65) that are formed along a leading-out direction of the electric wire (43) and divide the protrusion portion (60).

What is claimed is:

1. A connector connected to a mating connector, the connector comprising:

a housing that includes a connection portion protruding toward a front side being a connection side with the mating connector and being capable of fitting to the mating connector, and of which a rear side is opened, a terminal that includes a connection terminal portion and an electric wire connection portion, and that is mounted to the housing by inserting the connection terminal portion into a terminal accommodation portion formed in the connection portion;

an electric wire that is connected to the electric wire connection portion of the terminal and is led out from the housing;

a ferrite core that is mounted to the electric wire and is assembled from the rear side of the housing; and a cover that is mounted to a rear surface of the housing and covers the terminal and the ferrite core assembled to the housing, wherein the cover includes a first facing surface and a recessed facing surface, the cover receives an end portion of the ferrite core inclined by an external impact, on the recessed facing surface facing the ferrite core assembled to the housing, the first facing surface faces the ferrite core assembled to the housing, and the recessed facing surface is recessed with respect to the first facing surface.

2. The connector according to claim 1, wherein an edge at a connection portion side is disposed between the connection portion and a center of gravity of the ferrite core, and is a fulcrum of the ferrite core when the ferrite core is inclined toward a recessed portion side by the external impact.

3. The connector according to claim 1, wherein the housing includes a protrusion portion that protrudes toward a cover side and locks an end portion of the ferrite core, at an edge portion on a leading-out side of the electric wire, and wherein the protrusion portion includes a guide surface that is inclined toward the cover side toward the leading-out side of the electric wire.

4. The connector according to claim 3, wherein the protrusion portion includes a tapered surface that is inclined toward the cover side toward the connection portion side.

5. The connector according to claim 3, wherein the housing includes a plurality of slits that are formed along a leading-out direction of the electric wire and divide the protrusion portion.

6. The connector according to claim 2, wherein the housing includes a protrusion portion that protrudes toward a cover side and locks an end portion of the ferrite core, at an edge portion on a leading-out side of the electric wire, and wherein the protrusion portion includes a guide surface that is inclined toward the cover side toward the leading-out side of the electric wire.

7. The connector according to claim 6, wherein the protrusion portion includes a tapered surface that is inclined toward the cover side toward the connection portion side.

8. The connector according to claim 4, wherein the housing includes a plurality of slits that are formed along a leading-out direction of the electric wire and divide the protrusion portion.

9. The connector according to claim 6, wherein the housing includes a plurality of slits that are formed along a leading-out direction of the electric wire and divide the protrusion portion.

10. The connector according to claim 7, wherein the housing includes a plurality of slits that are formed along a leading-out direction of the electric wire and divide the protrusion portion.

11. The connector according to claim 3, wherein the housing includes a plurality of slits that divide the protrusion portion into a central protrusion portion and side protrusion portions, and wherein the side protrusion portions have tapered surfaces that are inclined along the width direction of the connector.

12. The connector according to claim 2, wherein the edge is located between the first facing surface and the recessed facing surface and is spaced away from the recessed facing surface.

13. The connector according to claim 12, wherein the cover includes a first side wall and a second side wall this is spaced away from the first side wall, and each of the first facing surface, the recessed facing surface, and the edge extend from the first side wall to the second side wall.

14. The connector according to claim 13, wherein the cover includes an inclined surface that extends from the edge to the recessed facing surface.

* * * * *